US005801684A

United States Patent [19]

Uskali

[11] Patent Number: 5,801,684

[45] Date of Patent: Sep. 1, 1998

[54] ELECTRONIC DEVICE WITH DISPLAY AND DISPLAY DRIVER AND METHOD OF OPERATION OF A DISPLAY DRIVER

[75] Inventor: Robert George Uskali, Schaumburg, Ill.

[73] Assignee: Motorola, Inc., Schaumburg, Ill.

[21] Appl. No.: 609,755

[22] Filed: Feb. 29, 1996

[51] Int. Cl.[6] ..... G09G 5/00

[52] U.S. Cl. ..... 345/213; 345/211; 345/87; 345/102; 395/750.01

[58] Field of Search ..... 345/207, 87, 101, 345/102, 211, 213, 117; 395/750.01

[56] References Cited

U.S. PATENT DOCUMENTS

| | | | |
|---|---|---|---|
| 3,683,357 | 8/1972 | Presnick et al. | 345/211 |
| 3,921,162 | 11/1975 | Fukai et al. | 345/101 |
| 5,184,117 | 2/1993 | Gauthier | 345/102 |
| 5,406,305 | 4/1995 | Shimomura et al. | 345/102 |

FOREIGN PATENT DOCUMENTS

| | | | |
|---|---|---|---|
| 1167734 | 3/1989 | Japan | 345/101 |
| 6160845 | 7/1994 | Japan | 345/87 |

OTHER PUBLICATIONS

Motorola Semiconductor Technical Data AN1202—"Battery Backup of Self-Refreshing Dynamic Random Access Memory", Jan. 1993, pp. 3–7.

Dallas Semiconductor DS1710—"Partitioned NV Controller", Apr. 22, 1993, pp. 4–20.

Dallas Semiconductor DS1605Y/AB—"Partitioned 4096K NV SRAM", May 26, 1993, pp. 4–1 thru 4–10.

Benchmarq bq2201—"SRAM Nonvolatile Controller Unit", Sep. 1991, pp. 4–1 thru 4–8.

Benchmarq bq2202—"SRAM NV Controller with Reset", Sep. 1991, pp. 4–9 thru 4–16.

Benchmarq bq2203—"NV Controller with Battery Monitor", Sep. 1991, pp. 4–17 thru 4–18.

Benchmarq bq2204—"X4 SRAM Nonvolatile Controller Unit", Sep. 1991, pp. 4–19 thru 4–26.

Benchmarq bq2502—"Integrated Backup Unit" Apr. 1991, pp. 4–27 thru 4–38.

Benchmarq bq2503—"Integrated Backup with Batter Monitor", Sep. 1991, pp. 4–39.

Jon Campbell—"Nonvolatile SRAMs Operate at 3 or 5 V", Electronic Design–Feb. 18, 1993, pp. 82, 84, and 85.

*Primary Examiner*—Richard A. Hjerpe
*Assistant Examiner*—Kent Chang
*Attorney, Agent, or Firm*—Pedro P. Hernandez

[57] ABSTRACT

An electronic device such as a personal digital assistant (PDA), a data terminal, a computer (particularly a portable computer) or a television (particularly a portable television), having a display (10) and a display driver (20). An ambient radiation sensor element (12) senses ambient radiation incident on the display; and an ambient radiation modulation measuring element (104) measures a frequency of modulation of ambient radiation sensed by the ambient modulation sensor element (12) The display driver (20) provides a display scanning signal to the display (10) at a frame rate synchronized to the modulation frequency of the ambient radiation.

15 Claims, 2 Drawing Sheets

ELECTRONIC DEVICE WITH DISPLAY AND DISPLAY DRIVER AND METHOD OF OPERATION OF A DISPLAY DRIVER

FIELD OF THE INVENTION

This invention relates to an electronic device having a display, such as a personal digital assistant (PDA), a data terminal, a computer (particularly a portable computer) or a television (particularly a portable television) and it relates to a display driver for such an electronic device.

BACKGROUND OF THE INVENTION

Many electronic devices have liquid crystal displays (LCD's). A large LCD comprises many pixels distributed in rows across and down a display or "screen". A display driver activates the pixels sequentially in a raster scan, controlling the opacity of the sequential pixels and thereby causing an image to appear on the display or screen.

A complete raster scan of the LCD screen is referred to as a frame. The number of complete frames presented from the display driver to the screen per second is called the frame rate. It is desirable to maintain the frame rate at a low level, because high frame rates require high clock frequencies, adding to the expense and adding to the drain on the power source. For portable equipment, generally powered by battery, low battery drain is an important design parameter. On the other hand, if the frame rate is too low, visible flicker becomes apparent to the human eye. Experience shows that an appropriate frame rate is approximately 50 to 60 Hz.

Due to their nature of operation, LCD's are prone to screen flicker when viewed under certain man-made lighting sources, such as some fluorescent light fixtures. Screen flicker is observed as "ripples" which "flow" through the display image at a frequency equal to the difference between the LCD frame rate and the ambient light modulation frequency (60 Hz for example). This screen flicker reduces image quality and can promote eye strain.

LCD frame rate adjustment and synchronization may be done to eliminate the screen flicker problem. In "desktop" devices that are powered from the AC mains, direct access to the AC mains frequency is available for synchronization to be employed. Wireless devices such as PDA's which typically are battery powered are not normally connected to the AC mains. For this reason, frame rate synchronization schemes cannot be employed that use a directly connected AC power mains as a reference.

In addition, it is not acceptable to set the LCD frame rate of the wireless device at a fixed frequency, even if general knowledge of the AC mains frequency is known. Typically, the AC mains frequency is either 50 Hz or 60 Hz depending on the country of origin. It is known that the tolerance of the AC mains frequency can vary as much as ±3 Hz. From experimental results, it is known that in order to eliminate the effects of screen flicker, the LCD frame rate must be held to within ±0.5 Hz of the power mains frequency. Based on these numbers, it can be seen that a fixed frame rate will not eliminate screen flicker.

There is a need for an improved device with display and an improved display driver.

A preferred embodiment of the invention, is now described, by way of example only, with reference to the drawings.

DETAILED DESCRIPTION OF THE DRAWINGS

Figure 1:
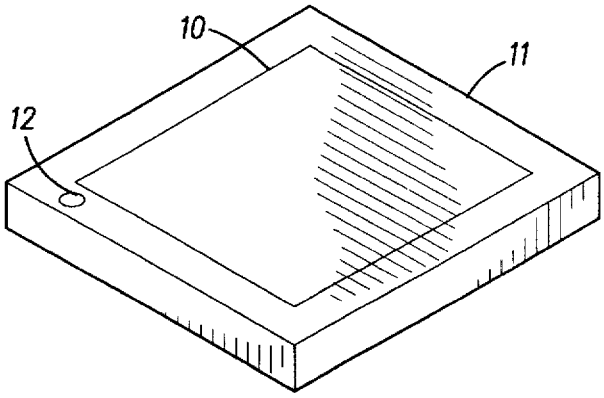
FIG. 1 is a perspective view of an electronic device with an LCD in accordance with the preferred embodiment of the invention.

Referring to FIG. 1, an LCD 10 is shown. The LCD 10 has horizontal rows and vertical columns of pixels for providing a complete two-dimensional image, as is known in the art. The LCD 10 is mounted on a housing 11, such as a portable PDA housing or other self-contained self-powered portable device. Mounted on the housing 11 adjacent to LCD 10 and on a face of the housing 11 in common with the LCD 10 (i.e. on the same side of the housing) is an ambient radiation sensor element, such as a photoresistor, photodiode or photo transistor. The ambient radiation sensor element is preferably, but not essentially, sensitive to visible light radiation. The ambient radiation sensor element 12 is shown in a position where it is sensitive to the ambient light that is directly incident on the LCD 10. It will be appreciated that the sensor element 12 could equally be mounted on the reverse side of the housing 11, or on one of its side faces. In these other positions it would also be sensitive to ambient light incident on the LCD 10 (by virtue of the reflection of the light on surrounding surfaces).

Figure 2:
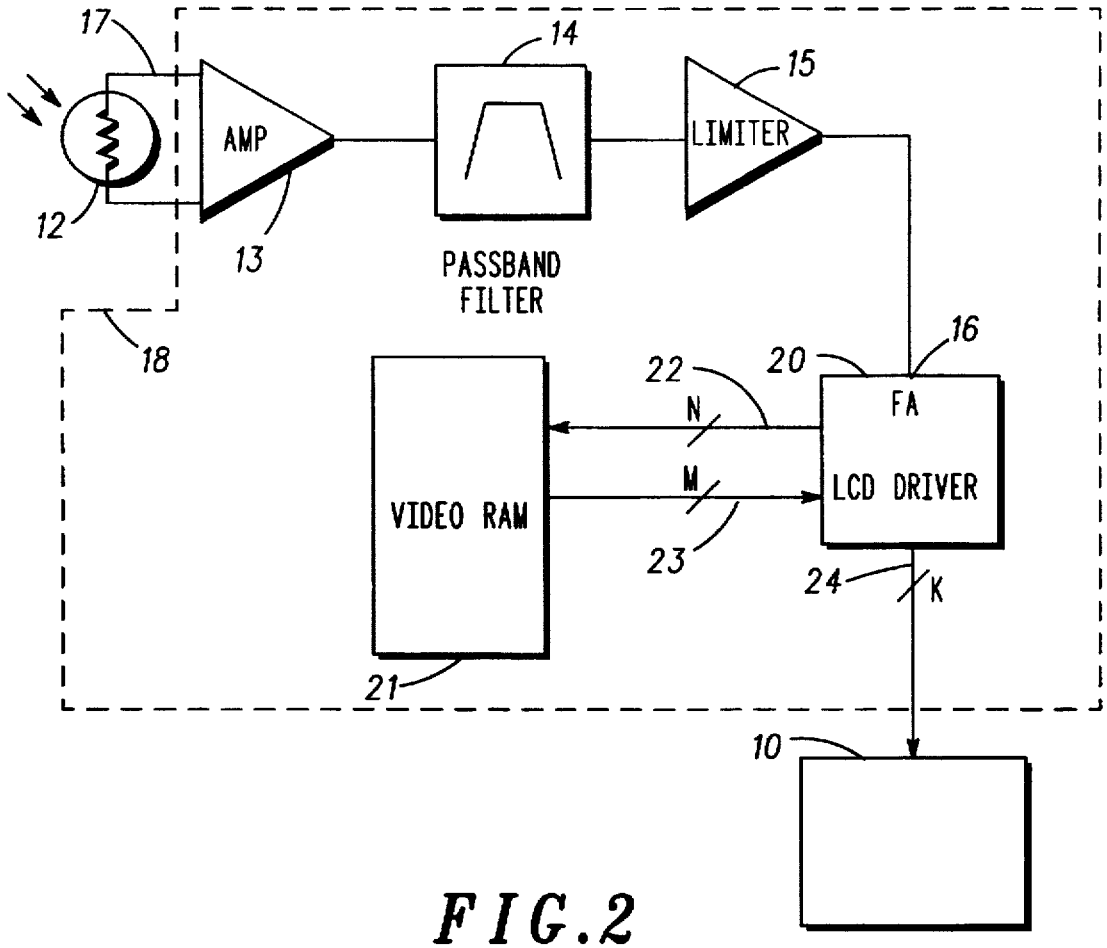
FIG. 2 is a block diagram of a display driver circuit in accordance with the preferred embodiment of the invention for operating the LCD of FIG. 1.

Referring to FIG. 2, it is shown that the ambient radiation sensor element 12 is coupled to an ambient radiation sensor element input 17 of a display driver circuit 18. Input 17 is an input of an amplifier 13, which is coupled to a pass band filter 14. An output of the filter 14 is coupled to a limiter amplifier 15. An output of the limiter amplifier 15 is coupled to a frequency adjust input 16 of an LCD driver 20. A video random access memory (RAM) 21 is also coupled to the LCD driver 20 by means of an address bus 22, having a width of N bits and a data bus 23 having a width of M bits. An output bus 24 from the LCD driver 20, which is K bits in width, is coupled from the LCD driver 20 to the LCD 10.

In general terms, the operation of the display driver circuit of FIG. 2 is as follows. Ambient light which is incident on the LCD 10 is sensed by the sensor element 12. The level of the ambient light is amplified by amplifier 13. The resultant signal is filtered by pass band filter 14, which passes a band of approximately 10 Hz to 200 Hz, although a wider or narrower band centered around approximately 50 to 60 Hz is also suitable. The resulting signal from pass band filter 14 is indicative of the modulation frequency of the ambient light falling on sensor element 12. The signal from the filter 14 is limited by limiter amplifier 15 to provide an output having sharp zero crossing transitions. The signal is provided to the LCD driver at input 16.

LCD driver 20 addresses the video RAM 21 by the address bus 22 and looks up video data for presentation on the LCD 10. This video data is presented on output bus 24 in a suitable format for presenting on the pixels of the LCD 10. Output bus 24 has a width of 4 bits, but could be 8 bits in width depending on the LCD 10. The role of the LCD driver 20 is to present the data on output bus 24 in correct sequence with correct timing so that a steady image is presented on the LCD 10. The data on bus 24 is presented in frames at a frame rate of approximately 50 Hz. LCD driver 20 synchronizes the frame rate of the data presented on bus 24 to the measured rate of the ambient radiation, as measured at input 16.

Figure 3:
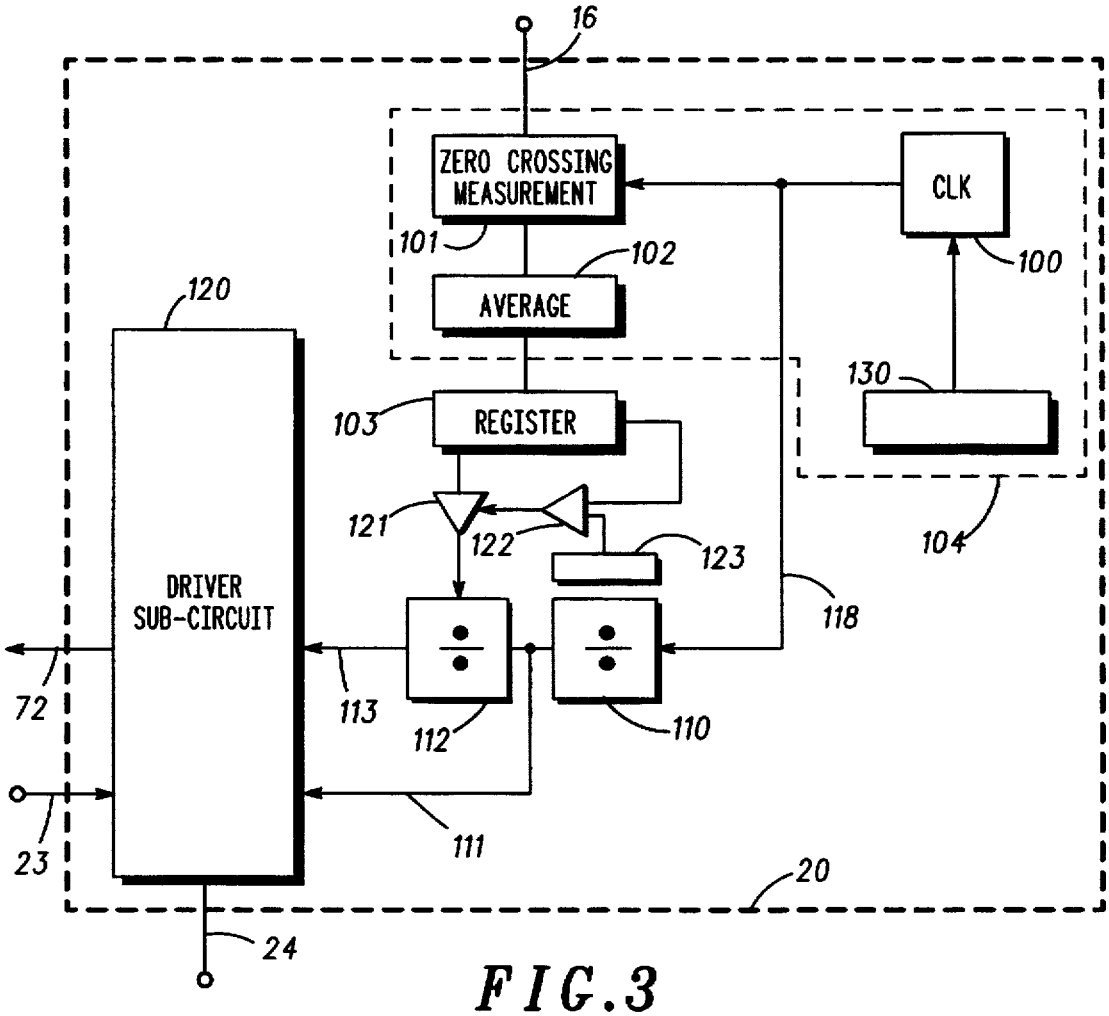
FIG. 3 is a block diagram of the LCD driver of FIG. 2 in greater detail.

A number of arrangements can be provided within driver 20 to synchronize the frame rate of the output data with the frequency of the ambient light modulation and a particularly preferred arrangement is illustrated in FIG. 3.

FIG. 3 shows details of the LCD driver 20 in accordance with the preferred embodiment. The circuit comprises a high speed clock 100 connected to a zero crossing measurement element 101, which is connected to the ambient light modulation frequency input 16. Zero crossing measurement element 101 is coupled to an averaging element 102, which in turn provides an output to a first register 103. Clock 100, zero crossing measurement element 101 and averaging element 102 together form an ambient radiation modulation measuring element 104.

Also connected to the output of the clock 100 is a first divider 110. Coupled to an output of the first divider circuit 110 is a second divider 112. Each of the dividers 110 and 112 provides an output (outputs 111 and 113 respectively) to a driver subcircuit 120. The first register 103 is coupled to the second divider 112 via a gate 121 for loading a divisor value into the second divider 112. The gate 121 is under the control of a comparator 122 having a first input coupled to the first register 103 and a second input coupled to a fixed reference value source 123 for storing at least one predetermined frame rate limit (and in the preferred embodiment two such limits—a higher limit and a lower limit).

A second register 130 is coupled to an input of the clock 100 for setting the pulse width of the timing pulses of the clock 100.

In operation, the clock 100 operates at a frequency which is at least as high as the frame rate multiplied by the number of pixels on the LCD 10 and divided by the width of the output bus 24. In the preferred embodiment the LCD 10 has 320 rows of pixels and 480 pixels per row, that is to say 153,600 pixels. With a frame rate of 50 Hz, and with bus 24 delivering a nibble of 4 bits per clock cycle, the minimum speed of the clock 100 is 1.92 MHz (i.e. 1,920,000 nibbles/second).

Using the clock signals from clock 100, zero crossing measurement element 101 measures the number of clock cycles between zero crossing signal transitions of the signal at input 16, thereby measuring the time between zero crossing signal transitions. Zero crossing measurement element 101 provides half-cycle time values to averaging element 102, which averages the values over time and provides to register 103 a value representative of the actual frequency of the ambient radiation modulation.

Simultaneous with the above operation, divider 110 divides the output 118 from clock 100 by a fixed value such as to provide at output 111 a clock signal at a rate which is equal to the nibble rate of the signal required for driving the LCD 10. This is supplied to driver subcircuit 120. The nibble rate is further divided by divider 112 using a divisor which is the nibble rate divided by the default frame rate (FD). Thus, the output 113 from divider 112 is equal to the frame rate (FR). Driver subcircuit 120 extracts frames of video data from RAM 21 at the frame rate (FR) provided by output 113 and feeds the results of data from data bus 23 to the output bus 24 to provide a display scanning signal to the LCD 10 at a clock rate defined by output 111 from dividers 110 and a frame rate defined by output 113 from divider 112.

Comparator 122 compares the measured ambient radiation modulation frequency from first register 103 with predefined upper and lower frame rate limits stored in fixed reference value source 123 and if the measured value falls outside these limits, it opens gate 121. Gate 121 causes a new divisor value to be loaded into divider 112. The new divisor value is equal to the nibble rate divided by the value stored in first register 103. Thus, the output 113 from divider 112 will, using the new value, have a frequency equal to the modulation frequency of the ambient radiation. In this manner, a new frame rate has been provided to driver subcircuit 120.

Driver subcircuit 120 awaits a new clock signal on output 113 before starting a new frame. At the start of a new frame, it clocks data out over output bus 24 at the clock rate defined by the signal on output 111.

Instead of changing the divisor of divider 112, the value stored in second register 130 can be set in response to comparator 122, with appropriate modifications of the circuit to maintain the necessary rate of clocking of data supplied by output 111 to the driver subcircuit 120.

The elements of FIG. 3 have been shown in hardware form by way of illustration, but it will be appreciated that the illustrated elements of driver 20 can be implemented in other forms, for example as a state machine, such as an application specific integrated circuit (ASIC) or in software in a processor circuit.

Implementations of an ambient radiation modulation measuring element 104 other than that shown in FIG. 3 can alternatively be provided. For example, a phase-locked-loop can be implemented in LCD driver 20. Such an arrangement would employ a voltage controlled oscillator having its frequency controlled by a phase comparator which compares the frequency of the signal at input 16 with a reference frequency divided down from the frequency of the voltage controlled oscillator. Another arrangement would be to provide a monostable providing a signal to an early-late gate which compares the time of the transitions of the signals presented at input 16 with transitions of the signal from the monostable and which extends or shortens the pulse width of pulses from the monostable dependent upon the early or late arrival of the transitions at input 16 with respect to the transitions from the monostable. Other suitable arrangements can be devised, including arrangements implemented in software and performed by a microprocessor.

Figure 4:
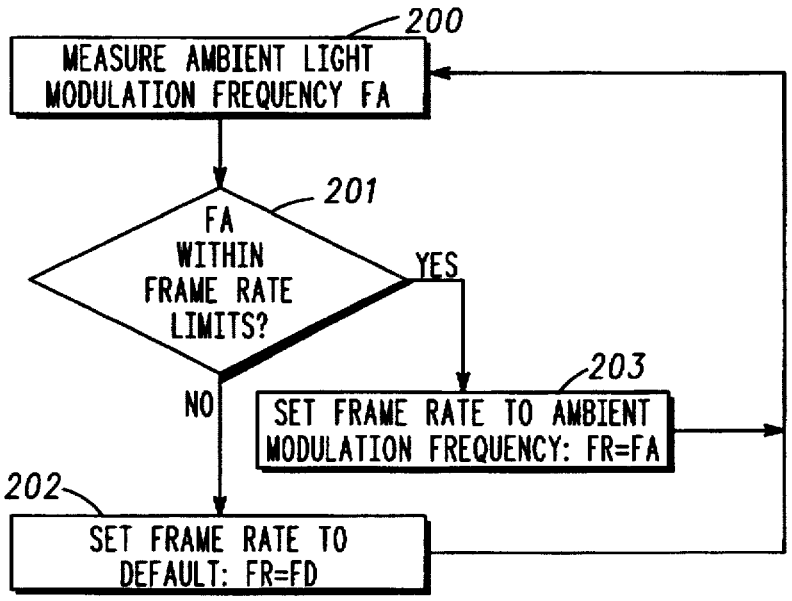
FIG. 4 is a flow diagram illustrating the operation of the driver of FIG. 3.

Referring to FIG. 4, a flow diagram illustrating operation of FIG. 3 is shown. Zero crossing measurement element 101 performs step 200 of measuring ambient light modulation frequency FA. Comparator 122 performs step 201 of comparing frequency FA with predetermined frame rate limits from fixed reference value source 123. These frame rate limits define the acceptable maximum and minimum frame rate values (also referred to as screen refresh rates). If the measured ambient light modulation frequency is outside these limits, step 202 is performed and the frame rate is set to the default value FD. This is achieved, for example, by maintaining the default divisor of divider 112. If the measured element ambient light modulation frequency FA stays within the acceptable limits, step 203 performs the step of setting the frame rate to the ambient modulation frequency. This is achieved by opening gate 121 in FIG. 3. In this mode, the frame rate tracks the ambient light modulation frequency and there is no apparent flicker on the screen.

Thus a method has been described comprising sensing ambient radiation having a modulation frequency, measuring the modulation frequency; and providing a display scanning signal to the display at a frame rate synchronized to the modulation frequency. The method comprises the steps of comparing the modulation frequency with predetermined frame rate limits, setting the frame rate to the modulation frequency if the modulation frequency falls within the frame rate limits and setting the frame rate to a default value if the modulation frequency falls outside the frame rate limits. The default value preferably lies between the frame rate limits.

The arrangement disclosed provides a means of adjusting the LCD frame rate of a wireless or other device to match the ambient light modulation frequency to eliminate screen flicker. The arrangement provides signals that represents the ambient light modulation frequency, FA. The ambient radiation sensor is located near the LCD screen and preferably in the same plane to insure that the light or other radiation sensed by the ambient radiation sensor element accurately represents the ambient light that falls on the display screen. The LCD driver which translates a video image data stored in video RAM to the LCD device uses the ambient radiation modulation frequency information according to the algorithm illustrated and described to adjust the LCD frame rate. In cases where the ambient radiation modulation frequency is not within acceptable limits, a default LCD frame rate frequency is used.

The acceptable limits of frame rates include a lower limit that is set to a frequency not much lower than 50 Hz, for example 45 Hz At frequencies less than 50 Hz the screen's refresh will become visually apparent to the human eye. The upper limit of the acceptable range is limited by the maximum rate in which the LCD driver hardware can transfer data from the video RAM to the LCD and needs not to extend much past 63 Hz, for example 65 Hz.

Adjusting the LCD frame rate to the ambient light modulation frequency FA is required to eliminate screen flicker. Many schemes for adjusting the frame rate can be realized and are not described in detail. To remove screen flicker it is required that the LCD frame rate be adjusted to within approximately 0.5 Hz of FA. Although it is acceptable to phase lock FA to the LCD frame rate, it is not required.

Instead of using an ambient light sensor as the ambient radiation sensor element 12, an ambient radiation sensor can be used in the form of an inductive loop sensor or similar electromagnetic radiation transducer which operates to measure modulation in the 50 to 63 Hz range of ambient radiation. This will serve to measure the frequency of line power sources which may be driving fluorescent lighting or other lighting incident on the display. The ambient radiation sensor may feed off a radio receiver integral to the electronic device, as is present in a PDA with wireless communication capability.

I claim:

1. An electronic device comprising:

a display;

a display driver coupled to the display for providing a display scanning signal to the display, the display scanning signal having a frame rate;

an ambient radiation sensor element for sensing ambient radiation incident on the display; and an ambient radiation modulation measuring element coupled to the ambient radiation sensor element for measuring a modulation frequency of radiation sensed by the ambient radiation sensor element and coupled to the display driver for providing the display scanning signal to the display at a frame rate synchronized to the modulation frequency of the ambient radiation.

2. An electronic device according to claim 1 wherein the ambient radiation sensor element is a light sensor element.

3. An electronic device according to claim 1 wherein the display is a liquid crystal display having rows of pixels.

4. An electronic device according to claim 1 wherein the ambient radiation sensor element and the display are mounted on a housing and wherein the ambient radiation sensor element and the display are mounted on a common face of the housing.

5. An electronic device according to claim 1 wherein the electronic device is a self-contained self-powered portable device.

6. A display driver circuit for driving a display of an electronic device comprising:

a display driver for coupling to a display for providing a display scanning signal to the display, the display scanning signal having a frame rate;

an ambient radiation sensor element input for coupling to an ambient radiation sensing element and for receiving a signal having a modulation frequency; and an ambient radiation modulation measuring element coupled to the ambient radiation sensor element input for measuring the modulation frequency and coupled to the display driver for synchronizing the display driver to the modulation frequency of the ambient radiation for providing the display scanning signal to the display at a frame rate synchronized to the modulation frequency.

7. A display driver circuit according to claim 6, comprising a limiter amplifier coupled between the ambient radiation sensor element input and the display driver for providing zero crossing signal transitions at an input of the display driver.

8. A display driver circuit according to claim 7, wherein the ambient radiation modulation measuring element comprises a zero crossing measurement element for measuring time between zero crossing transitions at the input of the display driver.

9. A display driver according to claim 6, further comprising a fixed reference value source for storing at least one predefined frame rate limit and a comparator coupled to the ambient radiation modulation measuring element for receiving from the ambient radiation modulation measuring element a measured value of ambient radiation modulation frequency and comparing the measured value with the at least one predefined frame rate limit.

10. A display driver according to claim 6, further comprising a band pass filter coupled between the ambient radiation sensor element input and the display driver.

11. A display driver according to claim 10, wherein the band pass filter passes a band of approximately 10 Hz to 200 Hz.

12. A method of operation of a display driver circuit for driving a display of an electronic device comprising:

sensing ambient radiation having a modulation frequency;

measuring the modulation frequency; and providing a display scanning signal to the display at a frame rate synchronized to the modulation frequency.

13. The method of claim 12 comprising the steps of:

comparing the modulation frequency with predetermined frame rate limits;

setting the frame rate to the modulation frequency if the modulation frequency falls within the predetermined frame rate limits; and setting the frame rate to a default value if the modulation frequency falls outside the predetermined frame rate limits.

14. The method of claim 13 wherein the default value lies between the frame rate limits.

15. The method of claim 14 wherein the predetermined frame rate limits are approximately 45 Hz and approximately 65 Hz.

* * * * *